US009718645B2

(12) United States Patent
Kocher et al.

(10) Patent No.: US 9,718,645 B2
(45) Date of Patent: Aug. 1, 2017

(54) DAMPING UNIT FOR AN ELEVATOR

(71) Applicant: Inventio AG, Hergiswil (CH)

(72) Inventors: Hans Kocher, Udligenswil (CH); Lorenz Etzweiler, Schenkon (CH)

(73) Assignee: Inventio AG, Hergiswil (CH)

( * ) Notice: Subject to any disclaimer, the term of this patent is extended or adjusted under 35 U.S.C. 154(b) by 148 days.

(21) Appl. No.: 14/402,707

(22) PCT Filed: May 24, 2013

(86) PCT No.: PCT/EP2013/060791

§ 371 (c)(1),
(2) Date: Nov. 21, 2014

(87) PCT Pub. No.: WO2013/175001

PCT Pub. Date: Nov. 28, 2013

(65) Prior Publication Data

US 2015/0151949 A1 Jun. 4, 2015

(30) Foreign Application Priority Data

May 24, 2012 (EP) ..... 12169299

(51) Int. Cl.

| | |
|---|---|
| ***B66B 11/02*** | (2006.01) |
| ***B66B 17/34*** | (2006.01) |
| ***B66B 1/36*** | (2006.01) |
| ***B66B 5/18*** | (2006.01) |

(52) U.S. Cl.

CPC ..... *B66B 11/0293* (2013.01); *B66B 1/365* (2013.01); *B66B 5/18* (2013.01); *B66B 17/34* (2013.01)

(58) Field of Classification Search

CPC ... B66B 11/0293; B66B 11/026; B66B 17/34; B66B 1/365; B66B 5/18; B66B 17/36

See application file for complete search history.

(56) References Cited

U.S. PATENT DOCUMENTS

| | | | | | |
|---|---|---|---|---|---|
| 988,759 | A | * | 4/1911 | Dupcza | B66B 17/34 187/360 |
| 1,819,502 | A | * | 8/1931 | Dunlop | B66B 5/18 187/375 |
| 1,839,235 | A | * | 1/1932 | Lindstrom | B66B 5/18 187/375 |
| 5,209,325 | A | * | 5/1993 | Gines | B60T 7/126 187/375 |
| 5,628,385 | A | | 5/1997 | Yumura et al. | |
| 5,648,644 | A | | 7/1997 | Nagel | |

FOREIGN PATENT DOCUMENTS

| | | | | |
|---|---|---|---|---|
| EP | 0899231 A1 | | 3/1999 | |
| EP | 1067084 B1 | | 12/2004 | |
| FR | EP 1460020 A1 | * | 9/2004 | B66B 5/18 |
| WO | 2011021064 A1 | | 2/2011 | |

* cited by examiner

*Primary Examiner* — William E Dondero
*Assistant Examiner* — Diem Tran
(74) *Attorney, Agent, or Firm* — Shumaker Loop & Kendrick; William J. Clemens

(57) ABSTRACT

An elevator damping unit, for reducing vertical oscillation of an elevator car during a standstill period, has brake shoe retainers provided with brake shoes. The brake shoe retainers are connected to an electric motor via a toothed gear mechanism. The damping unit also includes a spring device configured as a metallic bending spring and arranged between the car and a carrier structure for the brake shoe retainers.

11 Claims, 4 Drawing Sheets

DAMPING UNIT FOR AN ELEVATOR

FIELD

The invention relates to a damping unit for an elevator. Elevators contain cars that can be moved in an elevator shaft by means of a drive unit, via a suspension means in the form of a suspension cable or suspension belt, for example. Guide rails are installed in the elevator shaft, which define a linear guide for the elevator car. Persons or freight entering or exiting the stationary elevator car cause an undesired vertical oscillation of the car due to the elasticity of the suspension means. Such vertical oscillations occur in particular with elevators using suspension belts for the suspension means, which have gained in popularity in recent times. Because belts exhibit impractical vibratory characteristics in comparison with steel cables, the vertical oscillations have an increasingly negative effect on the comfort of the passengers and the on the operational reliability.

BACKGROUND

A device for preventing vertical oscillations of the elevator car during standstill phases has become known from EP 1 067 084 B1. The device has a brake caliper, which can be pressed against the guide rails via a compound lever mechanism. Brake shoes are disposed on the front ends of the brake caliper lever, This device causes a more or less rigid securing of the car to the guide rails as a result of friction. It has been shown, however, that in practice such securing devices place high demands on control and regulating technology. In particular, it is difficult, or complicated, respectively, to operate the elevator in such a manner that it is possible to smoothly initiate movement of the car after it has been at a standstill.

Instead of securing devices, it is also possible to achieve a sufficiently pleasant feeling of comfort for the passengers during a standstill of the car if the vertical oscillations of the car are simply damped, or reduced, for which purpose significantly smaller forces are required. A damping unit for reduction of vertical oscillations of the car during standstill phases is demonstrated, by way of example, in EP 1 424 302 A1. The damping unit exhibits a lever arm, extending over approximately half of the depth of the car, on the free end of which a pivotally supported brake shoe is disposed. The damping unit is mechanically coupled to a door opening unit for the car; this damping unit, which can be activated by the drive unit for the door, requires complicated lever and gear mechanism mechanics, for which reason this solution is expensive and prone to malfunction. The device also cannot be retrofitted to already existing, older elevator facilities. Another disadvantage is that the damping characteristics of the car do not satisfy higher demands regarding operational comfort and reliability.

An assembly for the reduction of vertical oscillations of an elevator car during a standstill is known from WO 2011/021064 A1, with which brake shoe retainers, centrally articulated on a lever arm, can be moved into position against the guide rails by means of a cylinder powered by an electric motor. The lever arms are connected in an articulated manner on one side to a base plate attached to a component of the car frame. Both lever arms have a two-piece design, wherein the respective lever arm parts can each be pushed against one another via a spring-supported damping mechanism comprising a helical compression spring. Undesired vertical oscillations during a car standstill are difficult to eliminate with this assembly, this being possible only with a high expenditure in terms of the control technology. Aside from the complicated construction, the assembly is also expensive and heavy. There is also the disadvantage that the assembly requires a lot of space.

SUMMARY

For this reason, one object of the present invention is to eliminate the disadvantages of the known damping units, and in particular, to create a damping unit with which the vertical oscillations of the elevator car during a standstill can be reduced in an optimal and simple manner. The damping unit should furthermore be suitable for installation in existing facilities. A retrofitting of the elevator facility should be possible in a simple manner, and with comparatively low costs.

These objectives shall be achieved according to the invention with a device having a damping unit, preferably equipped with two brake shoes, that contains brake shoe retainers, which are functionally connected to an actuator for moving the brake shoes. The brake shoes can move, when not in use during movement of the car, along a guide rail, without contact to said guide rail. After the actuator has been activated, which is connected to the brake shoe retainer in the manner of a gear mechanism, the brake shoes retained by the brake shoe retainers are pressed against the guide rails in an active position when the car is at a standstill. The damping unit further comprises a housing or some other supporting structure (e.g. in the form of a simple mounting plate) for the brake shoe retainer. Because the damping unit comprises a spring device attached to the supporting structure, which can be, or is, attached to the car, and serves as the spring-cushioned support for the supporting structure, a series of advantages are obtained. Undesired lateral displacements of the car transverse to the direction of travel can be absorbed and reduced in a simple manner with the spring device. Furthermore, production and assembly related tolerances between the guide rails and the brake shoes do not have a negative affect thereon.

The spring device is designed as a flexible spring made of metal. The flexible spring can be designed such that it can only be displaced in a two-dimensional manner. Furthermore, flexible springs have the advantage that they can be connected to both the supporting structure as well as the car. Flexible springs can also be manufactured in a simple and cost-effective manner. Lastly, flexible springs can be optimally adjusted to the desired degree of freedom.

It is particularly advantageous that the spring device is formed by a box-like profile, having a basically C-shaped cross-section. With a C-profile of this type, the desired two-dimensionally spring-cushioned support of the supporting structure can be achieved in an advantageous manner. The C-shaped profile can be disposed, or positioned, respectively in the damping unit, such that the longitudinal direction of the C-profile runs parallel to the braking surface of the brake shoes. A further advantage of a spring device of this type is that the hollow space defined by the C can be used to receive a guide shoe, entirely or in part, by means of which it is possible to obtain a compact elevator car having comparatively low structural heights.

The spring device can have a fastening section on or adjoining the supporting structure, for securing the supporting structure and two opposing lateral walls, adjoining the fastening section, preferably at basically a right angle. Furthermore, end sections can adjoin the lateral walls, in each case running parallel to the fastening section, via which the damping unit can be attached to the car. The end sections can have fastening means for securing the spring unit to the car, e.g. in the form of holes for receiving screws.

Furthermore, it may be advantageous if each brake shoe is supported by at least one spring element in a spring-cushioned manner at the respective brake shoe retainer. The additional cushioning of the brake shoes results in a further optimized behavior of the car during standstill phases. In particular, metal springs are suitable as the spring elements. In a preferred embodiment, the spring element can be a helical compression spring. The damping unit can have one, two or even numerous helical compression springs for each brake shoe.

It may further be advantageous if the brake shoes are disposed on the brake shoe retainers such that they can be displaced to a limited extent. For the limitation of the displacement path, the brake shoe retainers can be equipped with corresponding stops.

The brake shoes can be attached to support elements, or rest against such elements. The support elements can be made of a metal substance, such as steel, for example. For a spring-cushioned support of the brake shoes, the spring elements can abut the support elements on one side. In this manner, the spring elements can abut the brake shoe retainers on one side and the support elements on the other side.

For an optimal adjustment of the damping force, it is advantageous if the actuator comprises, preferably, a motor that can be driven electrically. This motor can be designed, for example, as a stepper motor, with which the desired pressure force can be set with great precision for reducing the vertical oscillations of the car.

It may be particularly advantageous, furthermore, if the damping unit has a shared motor for moving both brake shoes, with which the brake shoe retainers can move simultaneously, but in opposite directions.

The damping unit can have a supporting structure, formed, for example, by a housing, on which the brake shoe retainer is disposed, and preferably is supported such that it can be displaced. In the latter case, the direction of displacement would be transverse to the direction of travel for the car.

The damping unit can have an eccentric assembly, by means of which the brake shoes can be moved back and forth. Because of the eccentric assembly it is possible to adjust the resting position and the active position of the brake shoe retainer in a particularly simple and efficient manner. In particular, the eccentric mechanics enables a precise and, at the same time, simple pressurization of braking surfaces with a pressure force having a high transmission of force for reducing the vertical oscillations of the elevator car during standstill phases, whereby small actuators (e.g. electric motors) can be used.

An advantageous gear mechanism-type connection between the brake shoe retainers and the actuator is obtained when the actuator is connected to the brake shoe retainer via a gearwheel mechanism.

The gear mechanism can be designed, for example, as a spur gear gear mechanism, and exhibits a central drive gearwheel adjoining a drive shaft of the motor, and connected thereto such that it cannot rotate in relation thereto. Furthermore, the gear mechanism can have two eccentric gearwheels, wherein one eccentric gearwheel is allocated to one brake shoe in each case. The resting position or the active position can be defined for the brake shoes according to the rotational position of the central eccentric gearwheel, which can be driven by the drive gearwheel.

The eccentric gearwheels can have bearing pins that are disposed eccentrically (i.e. each eccentric gearwheel has one bearing pin), which each engage in bearing seats in the brake shoes in order to move the brake shoe retainers. The bearing pins define the resting position or the active position, depending on the rotational position.

The invention can further relate to an elevator having a car and having at least one damping unit of the type of damping unit described above. The spring unit is disposed between the supporting structure and the car, and forms, to a certain extent, a spring-cushioned interface to the car for the damping unit.

DESCRIPTION OF THE DRAWINGS

Further individual features and advantages of the invention can be derived from the following description of one embodiment example, and from the drawings. Shown are.

DETAILED DESCRIPTION

Figure 1:
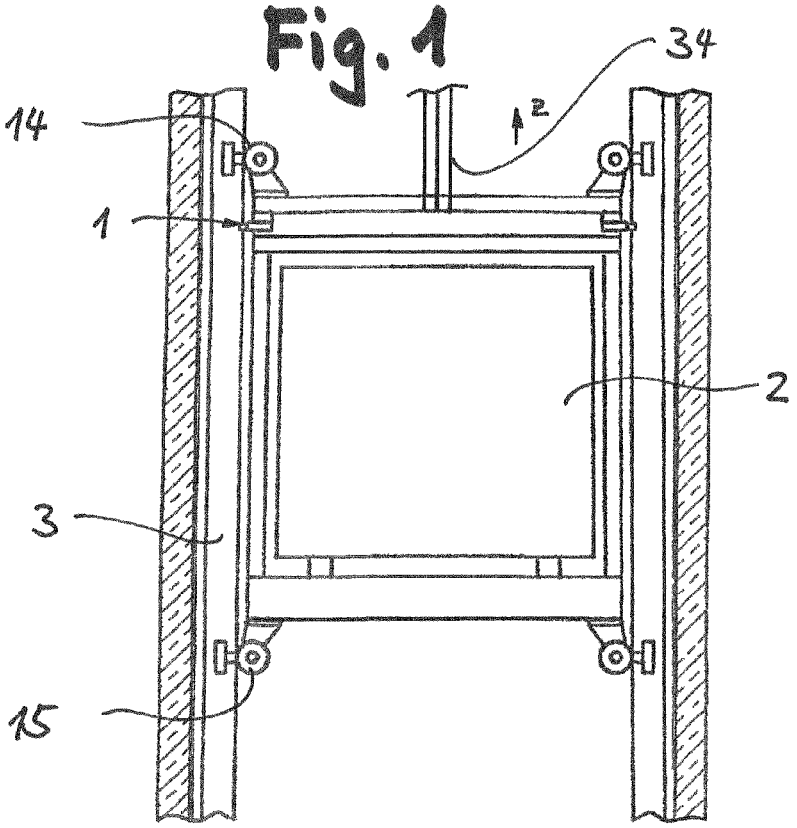
FIG. 1 is a simplified depiction of an elevator in a side view.

FIG. 1 shows an elevator having a car 2 that can be moved up and down for transporting people or freight. Suspension means 34 designed, by way of example, as belts or cables, serve as the suspension means for moving the car 2. For the guidance of the car 2, the elevator facility has two guide rails 3 extending in the vertical direction z. Each guide rail 3 has three guide surfaces thereby, extending in the direction of travel for the car. Guide shoes, designed in FIG. 1, by way of example, as roller guide shoes 14 and 15, are attached to the car 2. It is possible to reduce undesired vertical oscillations of the car during a standstill by means of the damping unit, indicated with the numeral 1. Vertical oscillations of this type occur when people enter or exit the car 2. The car 2 begins to oscillate as a result of the change in the load. This phenomenon is strongly pronounced, in particular, in suspension belt elevators having high shaft heights. The letter z indicates the direction in which the guide rails extend, and the arrow z also indicates the direction of travel for the car 2.

In order to reduce these vertical oscillations, the elevator facility has damping units 1 disposed on both sides of the car 2. The two damping units 1 can be activated by a (not shown) control device. The control device transmits a control command to the damping units as soon as the car stops, for example, or when the car door opens. The activation is normally maintained until the doors are again closed, and thus it is no longer possible to substantially change the load thereto. During the activation, the control device can transmit further regulating commands for the damping units.

Figure 2:
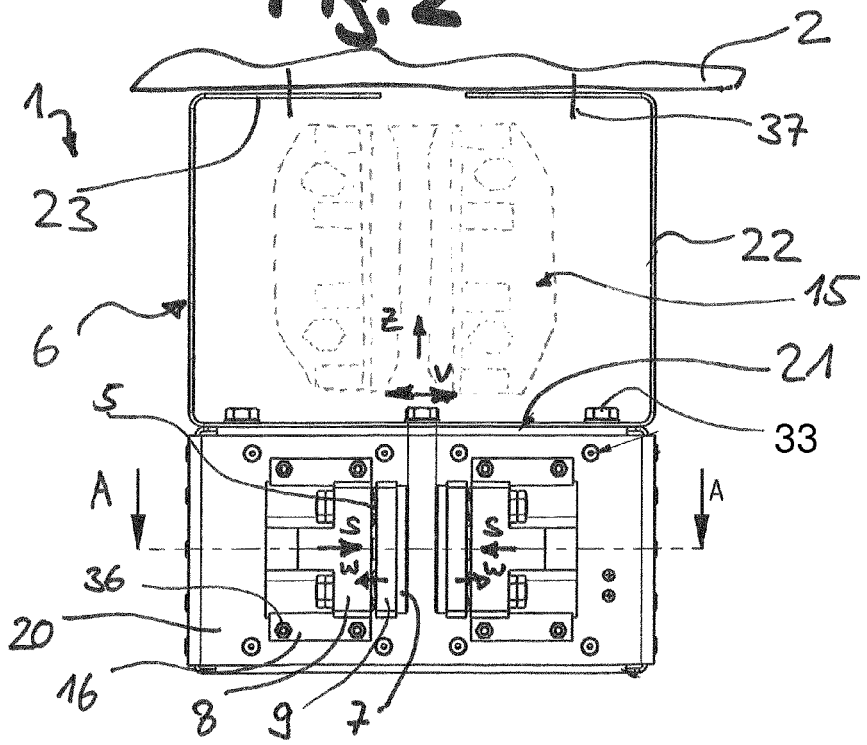
FIG. 2 is a depiction of a damping unit according to the invention, for an elevator.

In the embodiment example according to FIG. 1, the damping units 1 are attached, by way of example, to the top of the car 2, wherein they are located separately from the upper guide shoes 14. Depending on the configuration of the car and spatial requirements, the guide shoes and damping units can also be combined with, or disposed in relation to, one another, in another manner. In this manner, the at least one damping unit could also be attached to the bottom of the car. As can be derived, basically, from the following FIG. 2, the damping unit 1 can be attached to a console, which encompasses the guide shoe 15, either entirely or in part. In FIG. 2, the aforementioned console is designed as the spring device, indicated by the numeral 6, and to be described in detail below. The guide shoe 15, designed as a sliding guide shoe, and indicated by a broken line, is visibly encompassed by the device 6 in a "C" shape.

A damping unit 1 is depicted in FIG. 2 in a lateral front view. The damping unit 1 contains two opposing brake shoes 7, wherein each brake shoe faces one of the planar parallel guide surfaces of the (not shown here) guide rails. Each brake shoe 7 is retained by a brake shoe retainer indicated by the numeral 8. The brake shoe retainers 8 are guided laterally on guide elements 16, and can be moved toward the guide rails, or moved away therefrom. The respective directions of movement are indicated with arrows s. The individual guide elements 16 are attached to a housing 20 by means of screw fasteners 36.

The brake shoes 7 are supported, together with support elements 9, in a spring-cushioned manner on the brake shoe retainers 8. The brake shoes 7 yield when brought into contact with the respective guide surfaces of the guide rails, and move back in relation to the brake shoe retainers 8 in the w-direction. This additional spring-cushioned bearing is not, however, absolutely necessary. Tests have shown that with damping units that are equipped with spring devices designed as flexible springs, in which, however, the brake shoes are more or less rigidly connected to the brake shoe retainers, i.e. having brake shoes that are not supported in a spring-cushioned manner by means of mechanical springs, it is still possible to obtain satisfactory results with respect to travel comfort and operational reliability.

A box-like profile, having a C-shaped cross-section, is disposed in the region of the top surface of the housing 20. This C-profile forms a spring device 6, by means of which the housing 20 is supported in a spring-cushioned manner, together with the brake shoes 7 and the brake shoe retainer 8 disposed thereon, on the car, indicated by the numeral 2. The spring device 6, formed from sheet metal by means of a folding process, has a fastening section 21, lateral walls 22 adjoined thereto at a right angle, and end sections 23 adjoining the lateral walls at a right angle. The C-profile for the spring device 6 is preferably produced from a blank made of sheet steel. It is particularly preferred that spring steel is used thereby. The spring device 6 is thus clearly designed as a metal flexible spring. The spring deflection of the spring-cushioned support created by the spring device 6 is indicated by a double arrow v. The specific design of the spring device 6 results in a parallelogram configuration, which enables a basically parallel displacement of the housing 20 toward the bottom of the car 2 in the v-direction, or horizontally, transverse to the direction of travel z.

The end sections 23 of the spring device 6 lie flush on a part of the car 2, and are connected in a fixed manner thereto by means of a screw connection 37. The aforementioned car part can be formed, for example, by a car floor, a support frame for the car, or by another part allocated to the car.

Figure 3:
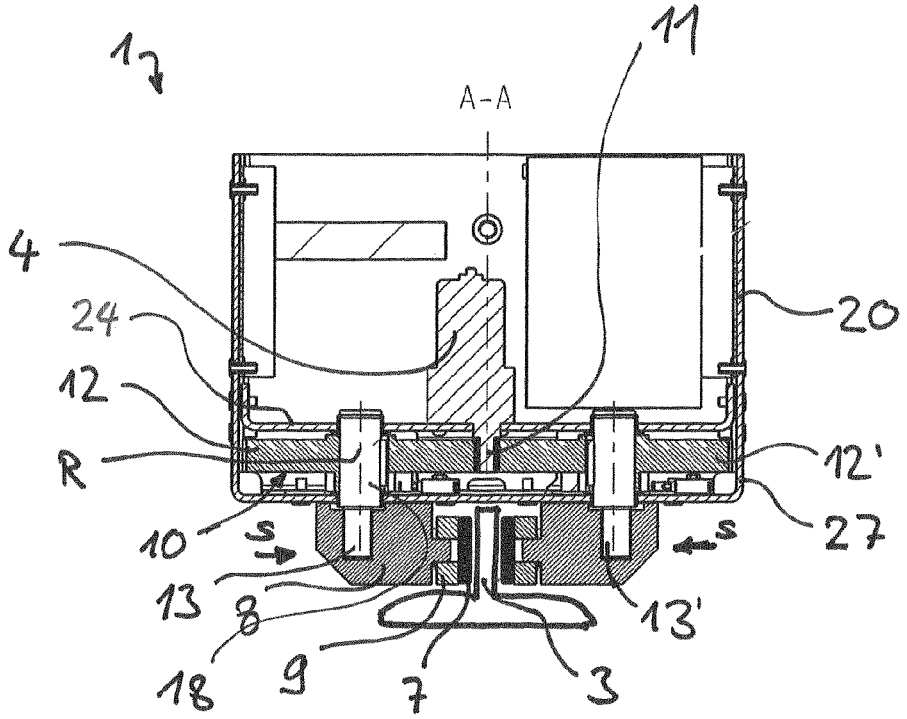
FIG. 3 is a cross-section cut through the damping unit (line A-A in FIG. 2)

Further details of the damping unit 1 can be discerned from the partial depiction according to FIG. 3. Furthermore, the guide rail 3 is depicted here. In the resting position shown in FIG. 3, the brake shoes 7 can travel along the guide rails 3 during movement of the car, without making contact therewith. During a standstill, the brake shoe retainers 8 are pushed, together with the brake shoes 7 disposed thereon, against the guide rails 3. The pressing of the brake shoes 7 against the respective guide surfaces of the guide rails 3 results in a reduction in the vertical oscillations of the car caused by changes in the load thereto. The activation can be triggered thereby, by way of example, through the opening of the door, or, if necessary, already prior thereto (e.g. as soon as the car is at a standstill). In the present case, an electric motor, indicated by the numeral 4, serves as the drive for moving the brake shoe retainer 8. As a rule, however, other actuators could also be taken into consideration, such as a linear actuator. The gear mechanism-like connection comprises a gear mechanism 10 and an eccentric gear assembly for converting the rotational movement to the linear movement in the s-direction.

The gear mechanism 10 has a central drive gearwheel 11, connected to the drive axle 17 (FIG. 5) of the electric motor 4, which drives the gearwheels, indicated by the numerals 12 and 12'. As can be derived from FIG. 3, as well as the following FIG. 4, the gear mechanism 10 is designed as a spur gear gear mechanism. As a matter of course, other types of gear mechanisms are also conceivable. The bearing pins 13 and 13' are disposed eccentrically to the rotational axes R of the gearwheels 12, 12', for which reason the two gearwheels 12, 12' shall be referred to as "eccentric gearwheels" in the following. The respective eccentric gearwheels 12, 12' are non-rotatably connected to axle components 18 on which the bearing pins 13 are formed at the end surfaces.

Figure 4:
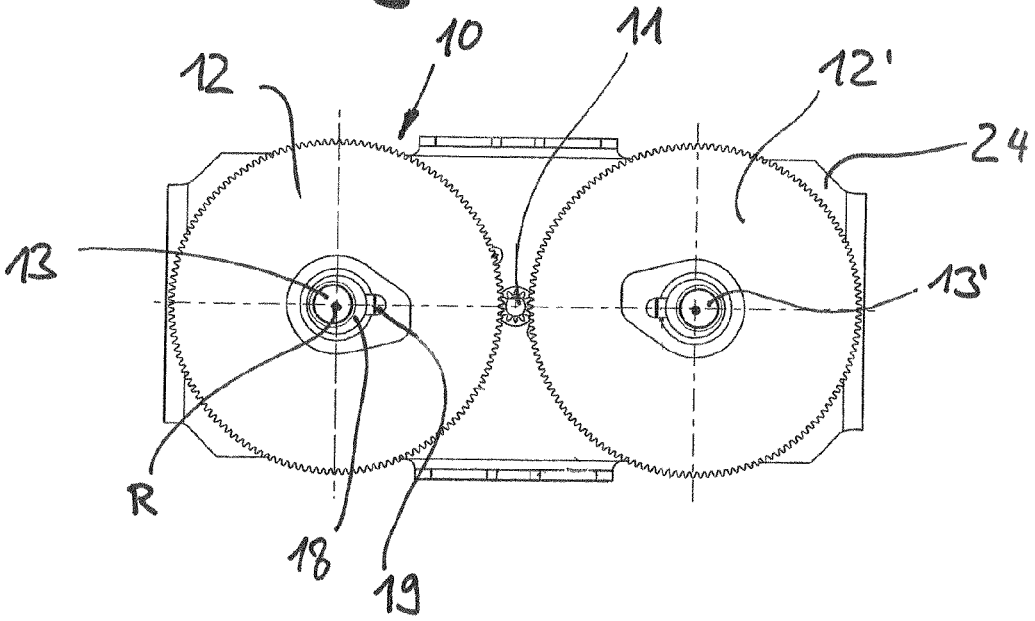
FIG. 4 shows a gear mechanism for the damping unit according to FIG. 2.

Details regarding the arrangement and function of the gear mechanism 10 in the damping unit are shown in FIG. 4. The respective eccentric gearwheels 12, 12' are permanently connected in a form-locking manner to the axle component 18, which can rotate about the rotational axis R, via a shaft-hub connection. In the resting position shown here, the tappets 19 (e.g. fitted keys) face one another. The bearing pins 13 or 13' are received eccentrically in a bearing hole in the brake shoe retainer, such that they can rotate, and function together with the respective bearing holes such that when the bearing pins 13, 13' rotate, the brake shoe retainers, and thus the brake shoes as well, can be moved back and forth horizontally. It is clearly visible in FIG. 4 that the geometric axis of the bearing pin 13 is not aligned with the rotational axis R of the eccentric gearwheel 12, and is thus disposed eccentrically. In order to obtain the active position, the motor is activated. The bearing pins 13, 13' connected to the motor via the gear mechanism then rotate 180° in each case about the R-axes, whereby the brake shoes are pushed against the corresponding guide surfaces of the guide rails, and pressed against them.

Figure 5:
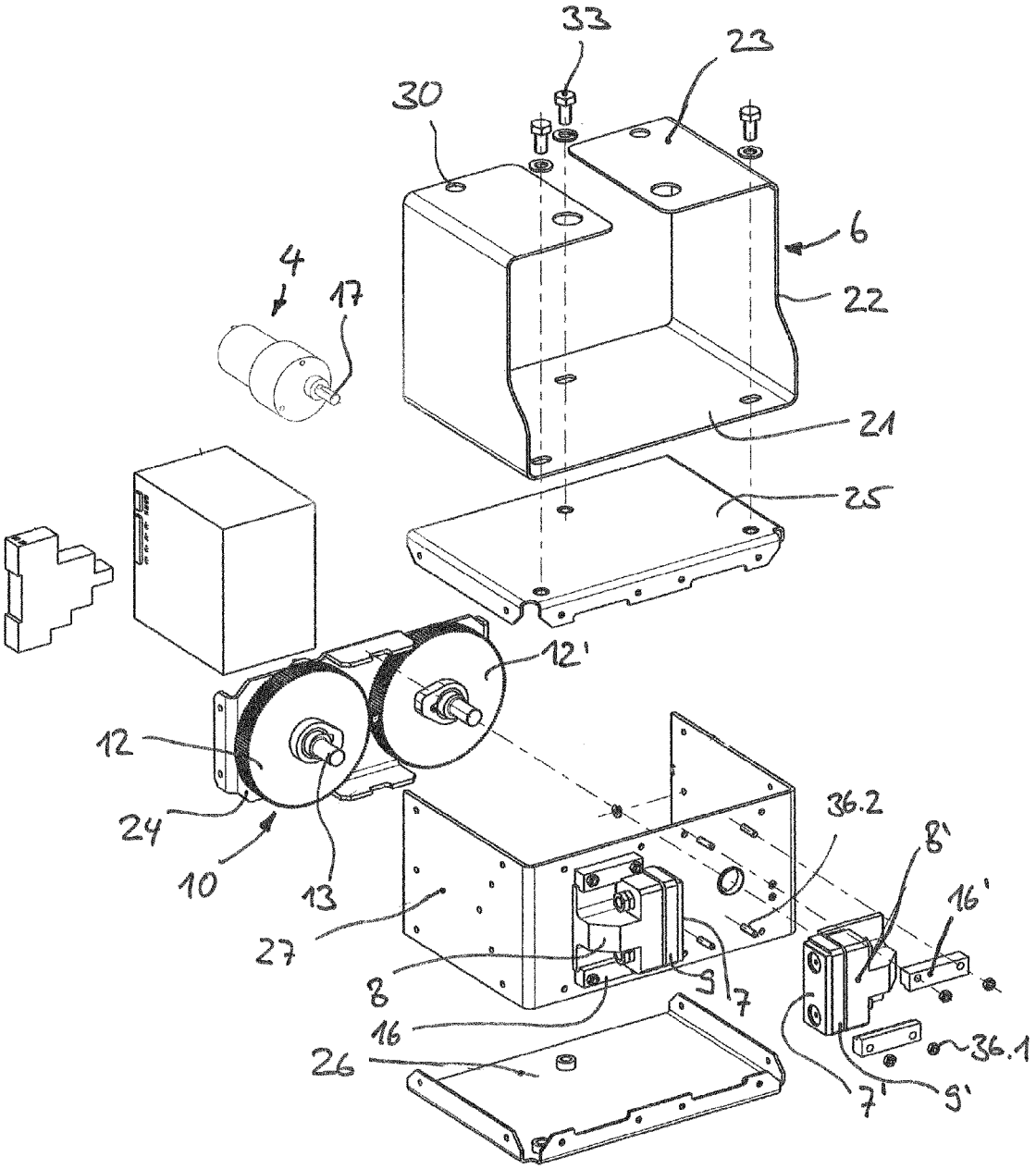
FIG. 5 is a perspective exploded depiction of the damping unit.

The individual components of the damping unit can be seen in FIG. 5. An assembly comprises, in each case, one brake shoe 7 and one brake shoe retainer 8, which can move laterally, back and forth, on rail-like guide components 16, transverse to the direction of travel, or to the longitudinal direction of the profile of the guide rails. A separate assembly can be seen at the bottom right region in FIG. 5, wherein the brake shoes and brake shoe retainer are indicated here with the numerals 7' and 8'. It is thus clear from FIG. 5 that the supporting structure is substantially a three-part construction, and consists of a housing bottom part 26, a housing upper part 25, and a housing part 27 having a U-shaped cross-section when seen from above. The guide components 16' are attached to the housing part 27 by means of bolts 36.2 and nuts 36.1. The gear mechanism 10 can be pre-installed on a back wall 24 made of sheet metal, which is then installed in the rest of the housing during the final installation.

The spring device 6, executed as a C-shaped flexible spring, has end sections 23 facing one another, which exhibit holes 30 for screw fasteners for attaching the spring device 6 to the (not shown here) car. The spring device 6 is attached and thus secured, in a region on the top surface 25, to the damping unit housing by means of screws 33.

Figure 6:
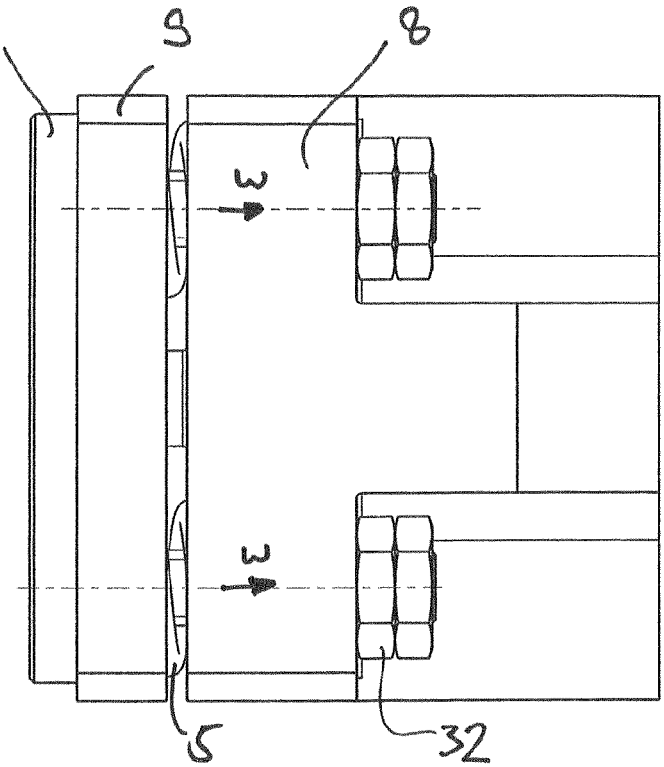
FIG. 6 is an enlarged depiction of an assembly, having a brake shoe retainer and a brake shoe for the damping unit according to FIG. 2.
Figure 7:
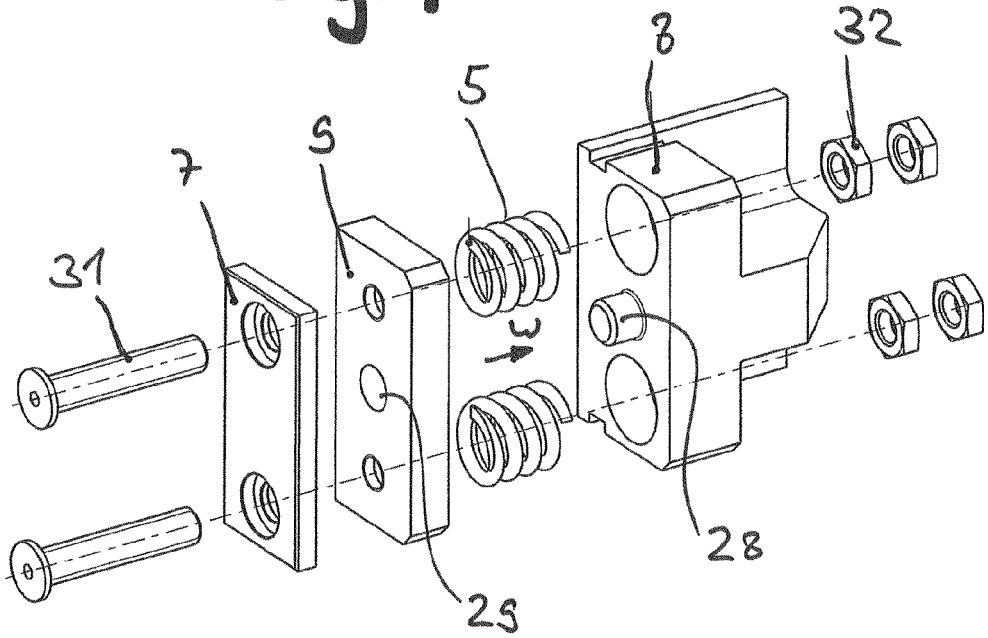
FIG. 7 is a perspective exploded depiction of the assembly in FIG. 6.

FIGS. 6 and 7 show an assembly (or brake shoe unit, respectively) having a brake shoe retainer 8 and brake shoes 7. The brake shoes 7 can be made from a metal material. The brake shoes 7 can also be made from a plastic material, or a mixture of materials. Advantageous braking surfaces for the intended reduction of the vertical oscillations of the car can be obtained, for example, when the known brake pads, referred to, at least in the automotive industry, as "semi-metallic," "organic," or "low-metallic" brake pads, are used for the brake shoes.

The brake shoes 7 lie on a comparably rigid support element 9 made of steel. The brake shoe 7 supported on the support element 9 is supported in a spring-cushioned manner via two helical compression springs 5 on the brake shoe retainer 9. The arrow w indicates the direction of movement for the return movement of the brake shoe 7 when pressure is applied to the guide rails. The brake shoe 7 is disposed on the brake shoe retainer 8 such that it can be displaced to a limited extent, together with the associated support element, limited by means of bolts 31 and nuts 32. Depending on the requirements, the inner, or front nuts 32 can be tightened to the extent that the brake shoe 7 is pre-tensioned, The outer, or rear nuts serve as counter-nuts. In order to ensure a linear movement of the brake shoe 7 to the greatest possible extent when pressed against the guide rail, a cylindrical guide pin 28 is disposed on the brake shoe retainer, and a guide recess 29 is disposed in the supporting element, complementary to the guide pin.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A damping unit for an elevator, for reduction of vertical oscillations of an elevator car during a standstill thereof, comprising:

brake shoe retainers provided with brake shoes, that lie opposite one another, and which are moved between a resting position and an active position by an actuator, wherein the brake shoes can move, in the resting position during travel by the car, along a guide rail without making contact therewith, and during a standstill of the car can be pressed against the guide rail in the active position;

the brake shoe retainers being connected to the actuator by a gear mechanism;

a housing in which the brake shoe retainers are positioned; and a spring device attached to the housing and adapted to be attached to the car, the spring device configured to couple the housing to the car, wherein the spring device is a flexible spring made of metal.

2. The damping unit according to claim 1 wherein the spring device forms a basically C-shaped profile in cross-section.

3. The damping unit according to claim 1 wherein the spring device has a fastening section lying against or on the housing for attaching to the housing and two opposing lateral walls adjoining the fastening section at approximately right angles.

4. The damping unit according to claim 3 wherein end sections running parallel to the fastening section adjoin each of the lateral walls, the end sections enabling the damping unit to be attached to the car.

5. The damping unit according to claim 1 wherein the brake shoes are each supported in a spring-cushioned manner on a respective one of the brake shoe retainers by at least one spring element.

6. The damping unit according to claim 5 wherein the brake shoes are disposed on the brake shoe retainers such that the brake shoes can be displaced to a limited extent.

7. The damping unit according to claim 5 wherein the brake shoes are attached to support elements against which the spring elements abut on one side, for the spring-cushioned support of the brake shoes.

8. The damping unit according to claim 1 including a motor coupled to move the brake shoe retainers.

9. The damping unit according to claim 1 including an eccentric assembly for setting the brake shoes to the resting position and the active position.

10. The damping unit according to claim 1 disposed on the car.

11. The damping unit according to claim 10 being positioned adjacent a guide shoe on the car.

* * * * *